US007281817B2

(12) United States Patent
Hsieh et al.

(10) Patent No.: US 7,281,817 B2
(45) Date of Patent: Oct. 16, 2007

(54) LIGHT-EMITTING DIODE BASED TRAFFIC LIGHT

(75) Inventors: Chi-Tang Hsieh, Chung Ho (TW); Po-Laung Huang, Chung Ho (TW); Chan-Ching Lin, Chung Ho (TW)

(73) Assignee: Chip Hope Co., Ltd., Taipei Hsien (TW)

( * ) Notice: Subject to any disclaimer, the term of this patent is extended or adjusted under 35 U.S.C. 154(b) by 0 days.

(21) Appl. No.: 11/258,428

(22) Filed: Oct. 25, 2005

(65) Prior Publication Data

US 2007/0091612 A1 Apr. 26, 2007

(51) Int. Cl.
*F21V 7/00* (2006.01)

(52) U.S. Cl. ..... 362/235; 362/800; 362/802; 362/296; 362/346; 349/39; 349/32

(58) Field of Classification Search ..... 345/39, 345/32, 36; 362/800, 802, 296, 346
See application file for complete search history.

(56) References Cited

U.S. PATENT DOCUMENTS 4,384,271 A * 5/1983 Visser ..... 362/296
5,580,156 A * 12/1996 Suzuki et al. ..... 362/184
6,707,435 B1 * 3/2004 Merlato et al. ..... 345/39

* cited by examiner

*Primary Examiner*—Sandra O'Shea
*Assistant Examiner*—Anabel Ton

(57) ABSTRACT

A traffic light includes a circuit board on which linear arrays of light-emitting diodes (LEDs) are mounted in a V-shaped arrangement, an inner cover having a first inner surface facing the LEDs to receive light from the LEDs and an opposite, first outer surface forming elongate prisms inclined with respect to a predetermined axis at a predetermined angle of 65-80 degrees, and a front cover having a second inner surface facing the first outer surface of the inner cover to receive the light from the inner cover, and an opposite, second outer surface through which the light is further projected out of the traffic light. The second inner surface of the front cover forms a honeycomb structure including a plurality of hexagonal lens blocks, each composed of an array of individual lens segments.

9 Claims, 11 Drawing Sheets

LIGHT-EMITTING DIODE BASED TRAFFIC LIGHT

BACKGROUND OF THE INVENTION

1. Field of the Invention

The present invention relates generally to a traffic light, and in particular to a light-emitting diode (LED) based traffic light comprising a dual refractive layers in front of the LEDs to form uniform light projection through generation of multiple images of each LED that are close or partially overlap each other.

2. The Prior Arts

As compared to the traditional incandescent lamps, and other light sources, light-emitting diode (LED) has the advantages of low power consumption, high lighting efficiency and long life span. Traditionally, the LED, however, suffers poor brightness in lighting performance. This drawback has been overcome recently with the development of LED technology. Costs of manufacturing such high brightness LED are sufficiently low for regular lighting purposes. Thus, traffic lights, which must have sufficient brightness in order to provide visual indication to drivers and pedestrians in sun shining days, are now using LEDs as the light source, which reduces not only the overall power consumption, but also the maintenance expense.

An additional advantage of the LED based traffic light is that the sun phantom that often occurs in the incandescent lamp based traffic light in sun shining days can be eliminated and as a consequence, traffic accidents can be reduced.

Nevertheless, the currently available LED based traffic light has still deficiencies due to physical limitation in angle of light projection from the LED. Thus, the drivers and pedestrians who are located outside the available range of projection angle of traffic light cannot clearly identify the lighting status of the traffic light. This limitation cannot be overcome by simply increasing the brightness of LEDs.

Traffic lights with a front cover featuring light refraction to project the light from LEDs to a designated direction are currently available in the market. An example illustrating the front cover structure of the conventional traffic light is shown in FIGS. 1 and 2 of the attached drawings. The front cover, which is designated with reference numeral 10, has an inner, light incidence surface 11 that faces the LEDs of the traffic light. The light incidence surface 11 forms a plurality of raised strips functioning as prisms 13, each corresponding in position to an array of the LEDs and having curved face 131, a straight face 132, a convex lens structure 133, and a vertical face 134. The convex lens structure 133 is comprised of convex lenses 1331 that are lined up in a direction parallel to the raised strips and extend in a transverse direction.

Light from each LED is incident onto the associated prism 13 and is refracted by the faces of the prism 13 and leaving the front cover 10 through a light emission surface 12 in a direction that is downward inclined with respect to the horizon. The light is thus projected to the eyes of the drivers and the pedestrians that are usually located below the traffic light.

However, each prism 13 forms an individual projection, which may overlap each other, leading to alternate bright section 21 and dark section 22. As a consequence, the distribution of the projected light is non-uniform. Further, each individual LED can still be visually identified, although light from the LED has been refracted by the front cover to expand the coverage thereof. This further makes the light distribution non-uniform. Thus, visual observation of the traffic light is still poor.

Thus, the present invention is aimed to provide a traffic light having an enhanced light projection for improving visual observation by drivers and pedestrians.

SUMMARY OF THE INVENTION

An objective of the present invention is to provide a traffic light that projects light in a substantially uniform manner in a downward inclined direction to enhance visual observation by drivers and pedestrians.

Another objective of the present invention is to provide a light-emitting diode based traffic light that provides uniform light distribution without alternating bright and dark sections whereby visual observation is enhanced.

A further objective of the present invention is to provide a light-emitting diode based traffic light comprising an inner cover and a front cover configured to generate multiple images for each light-emitting diode. The multiple images in combination enhance visual observation of the light projected from the traffic light and also enhance visual aesthetics of light projection of the traffic light.

In accordance with the present invention, to realize the above objectives, a light-emitting diode based traffic light comprises a circuit board on which a plurality of light-emitting diodes (LEDs) is arranged in multiple linear arrays. An inner cover and a front cover are sequentially arranged in front of the LEDs to receive light from the LEDs. The front cover has an inner light incidence surface facing the inner cover and an opposite light emission surface facing away from the inner cover and the LEDs. Light is incident into the front cover through the light incidence surface and leaves the front cover through the light emission surface. The light incidence surface forms a plurality of hexagonal lens blocks that are compactly arranged in a honeycomb configuration. Each hexagonal lens block is comprised of lens. The inner cover is located between the LEDs and the front cover and has a light incidence surface facing the LEDs and an opposite light emission surface facing the front cover. The light emission surface forms a plurality of elongate prisms that is arranged to be symmetric about and inclined with respect to a central vertical line with an include angle of 65-80 degrees. The prisms are grouped in five of which the central one corresponds in position to each linear array of the LEDs. Remote ends of the prisms of each group are connected by curved sections.

Light emitted from the LEDs is refracted by the prisms of the inner cover to form multiple images, whereby intensity distribution of the light is enhanced. These images of light transmit through and are refracted by the front cover to project in a downward inclined direction and the distribution of the light intensity is further uniformed.

The present invention will become more obvious from the following description when taken in connection with the accompanying drawings, which show, for purposes of illustration only, preferred embodiments in accordance with the present invention. In the drawings:

DETAILED DESCRIPTION OF THE PREFERRED EMBODIMENTS

Figure 3:
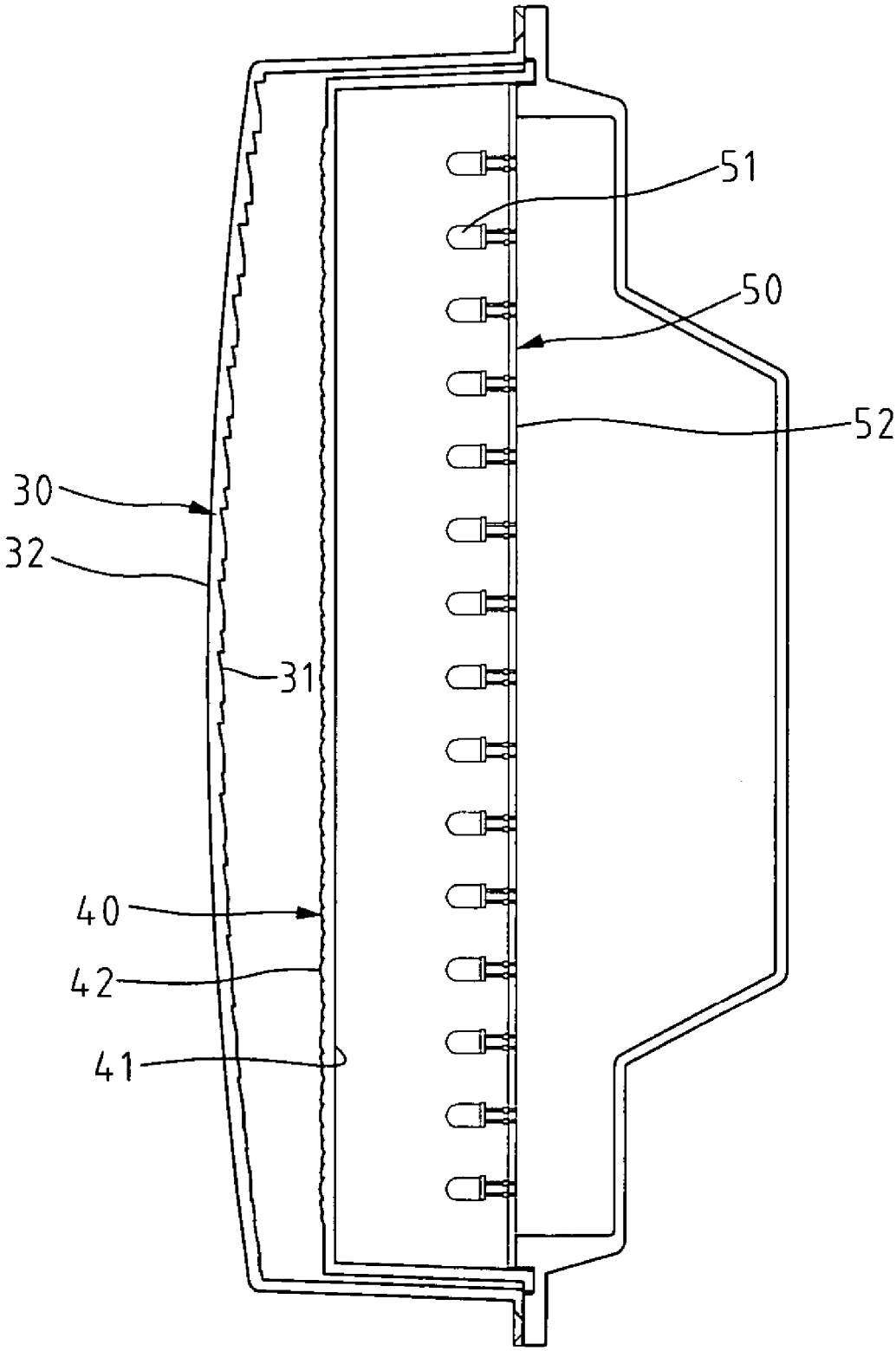
FIG. 3 is a cross-sectional view of a traffic light constructed in accordance with the present invention.
Figure 9:
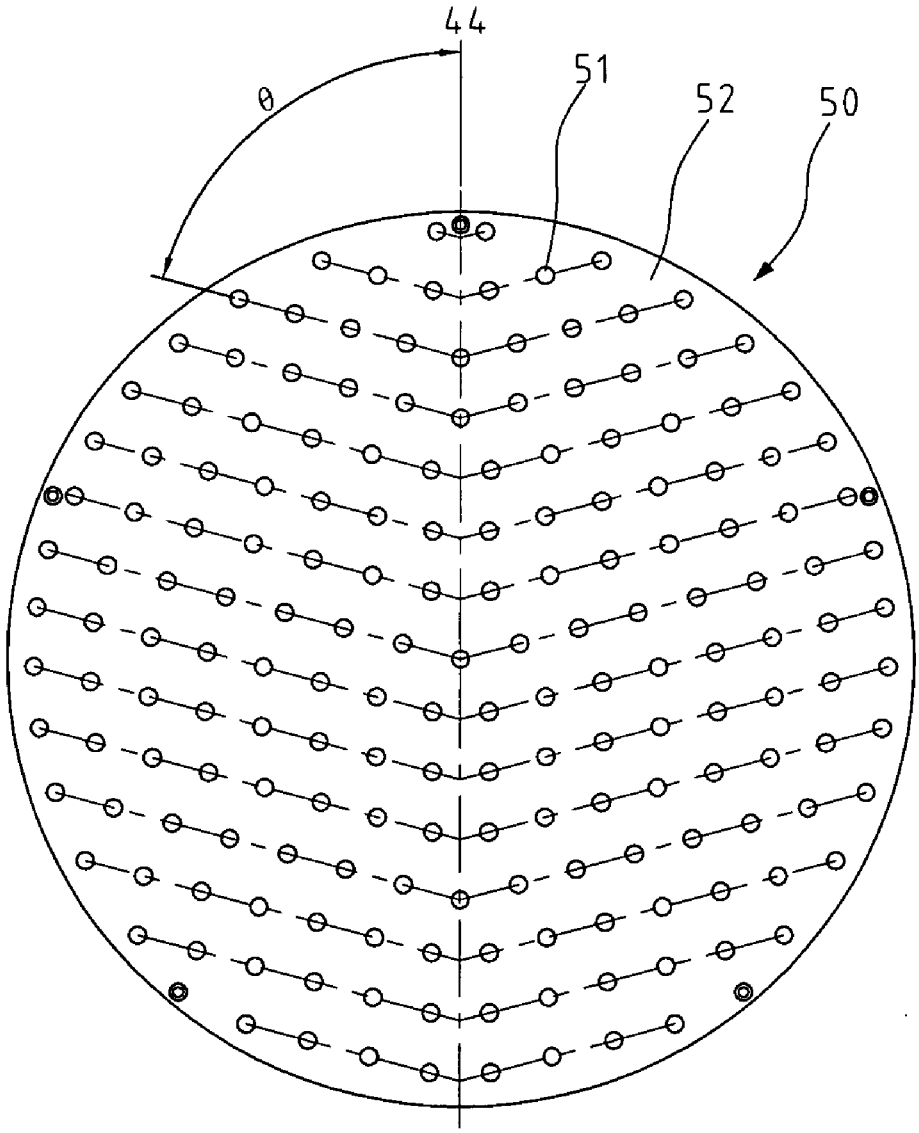
FIG. 9 is a front view of a circuit board of the traffic light in accordance with the present invention, illustrating arrangement of light-emitting diodes mounted on the circuit board.

With reference to the drawings, and in particular to FIG. 3, a traffic light constructed in accordance with the present invention comprises a front cover 30, an inner cover 40, and a light-emitting diode (LED) based light source 50. The front cover 30 has a light incidence surface 31 and an opposite light emission surface 32. The inner cover 40 has a light incidence surface 41 and an opposite light emission surface 42. The inner cover 40 is positioned between the front cover 30 and the light source 50 with the light incidence surface 41 facing the light source 50 and the light emission surface 42 facing the light incidence surface 31 of the front cover 30. The light source 50 comprises a circuit board 52 on which a plurality of LEDs 51 is mounted. The arrangement of the LEDs 51 on the circuit board 52 is particularly shown as an illustrative example in FIG. 9. Light emitted from the LEDs 51 is projected out of the traffic light after subjected to primary refraction by the inner cover 40 and secondary refraction by the front cover 30.

Figure 4:
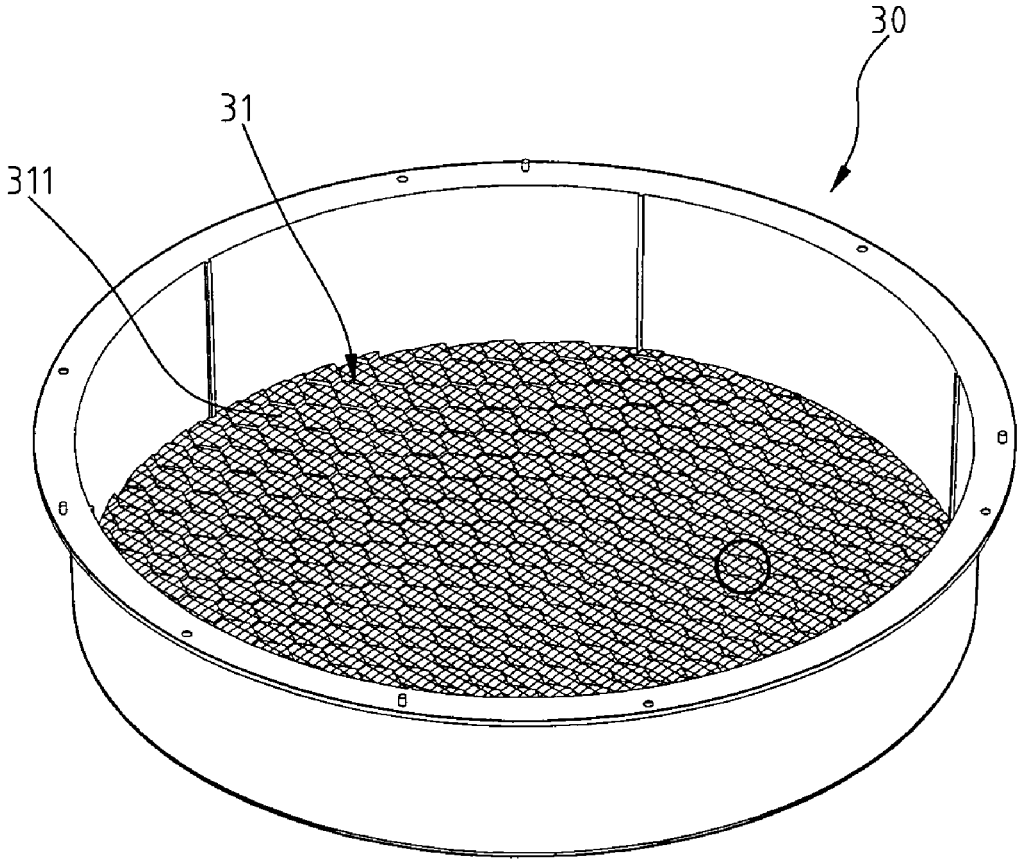
FIG. 4 is a perspective view of a front cover of the traffic light in accordance with the present invention.
Figure 5:
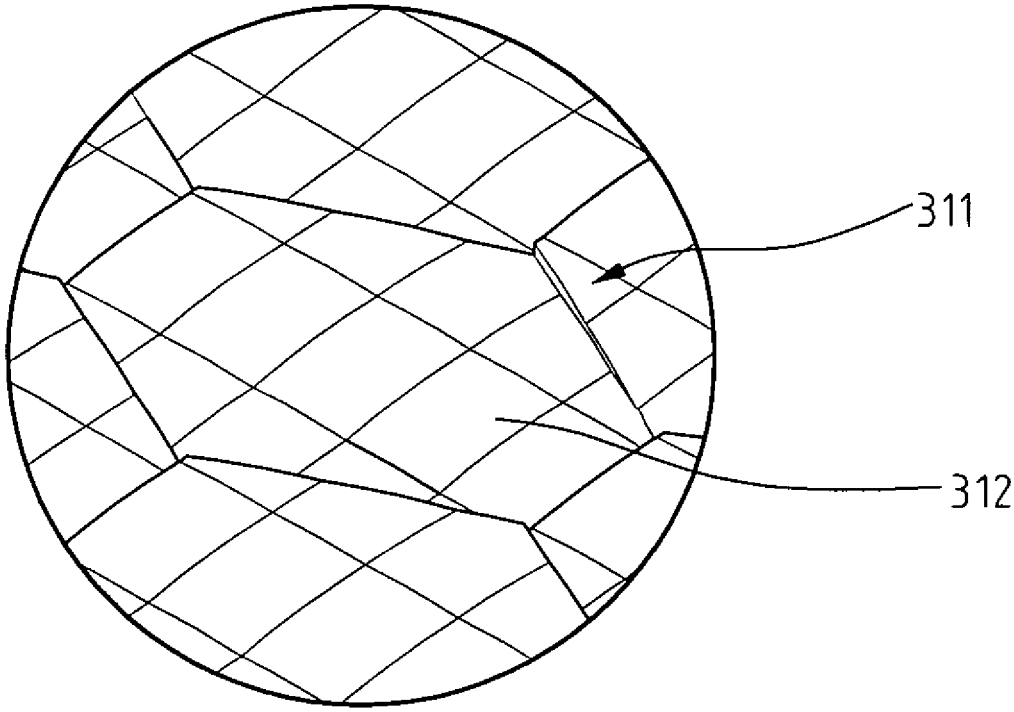
FIG. 5 is an enlarged view of the encircled portion of FIG. 4.
Figure 6:
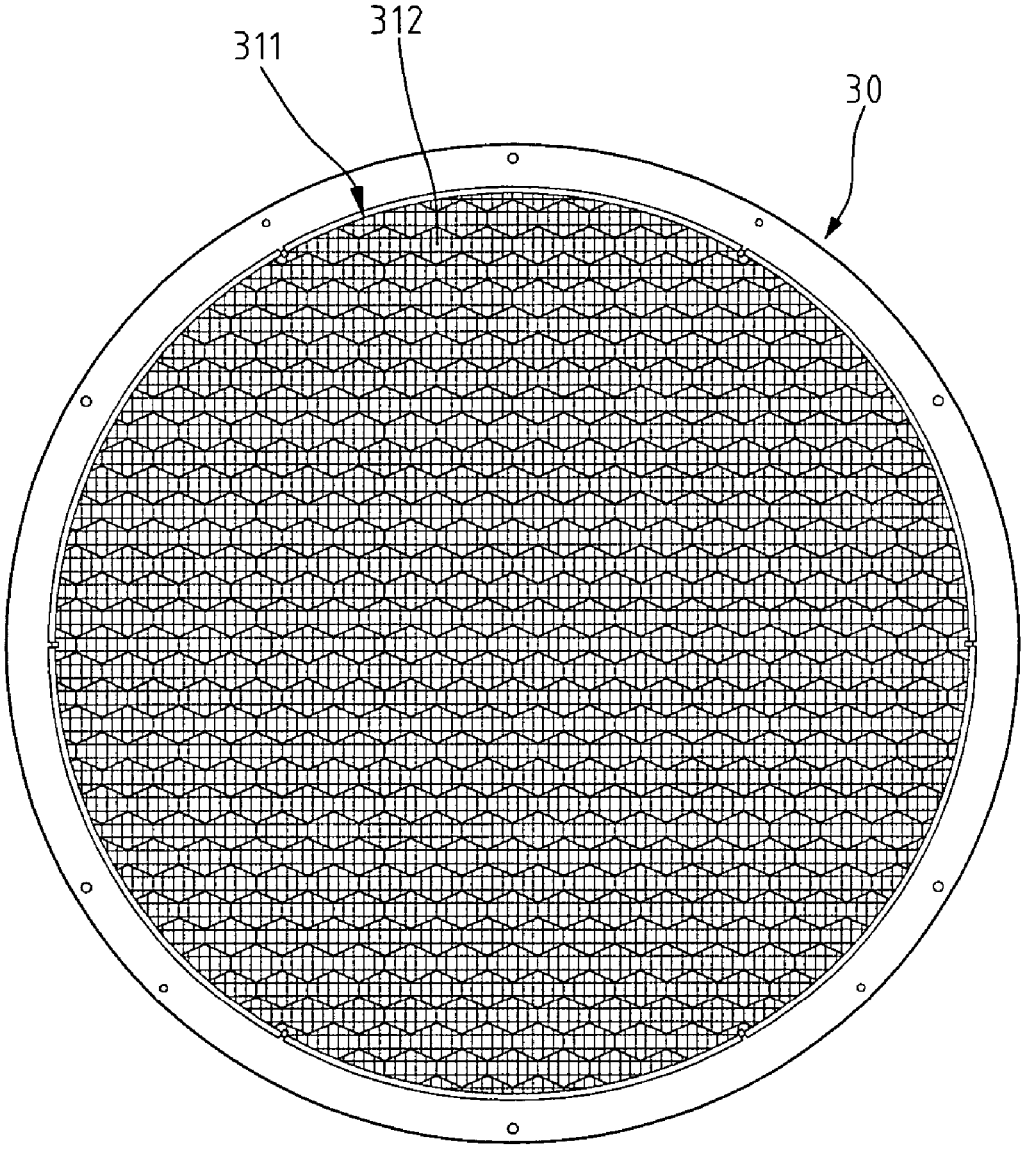
FIG. 6 is a front view of the front cover of the traffic light of the present invention.

Also referring to FIGS. 4-6, the light emission surface 32 of the front cover 30 comprises a smooth surface, which can be a flat surface, a convex surface or a concave surface. The light incidence surface 31 of the front cover 30 comprising a surface on which a plurality of hexagonal lens blocks 311 is concisely arranged in a honeycomb configuration. Each lens block 311 may be configured to have the same radii of curvature in both vertical and horizontal directions, or the radii of curvature in the vertical and horizontal directions are different. Each lens block 311 can be composed of a plurality of small segments, each serving as an individual lens 312 (best seen in FIG. 5. The lens segments 312 can be of rectangular shapes and arranged in a matrix or a two-dimensional array. The lens segments 312 can be of other shapes, such as polygon or circle. Radii of curvature in the vertical and horizontal directions can be the same or different for each lens segment 312.

Figure 1:
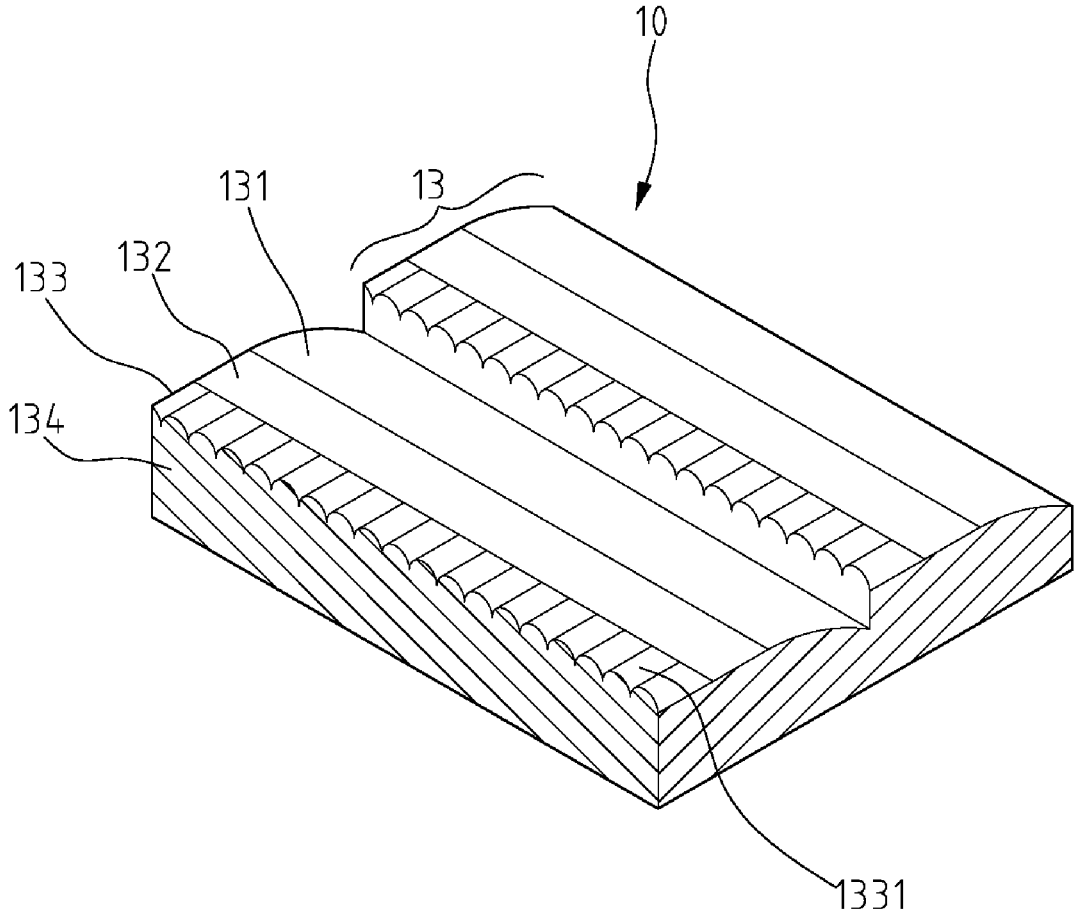
FIG. 1 (Prior Art)
FIG. 1 is a perspective view showing a portion of a front cover for a conventional traffic light.
Figure 2:
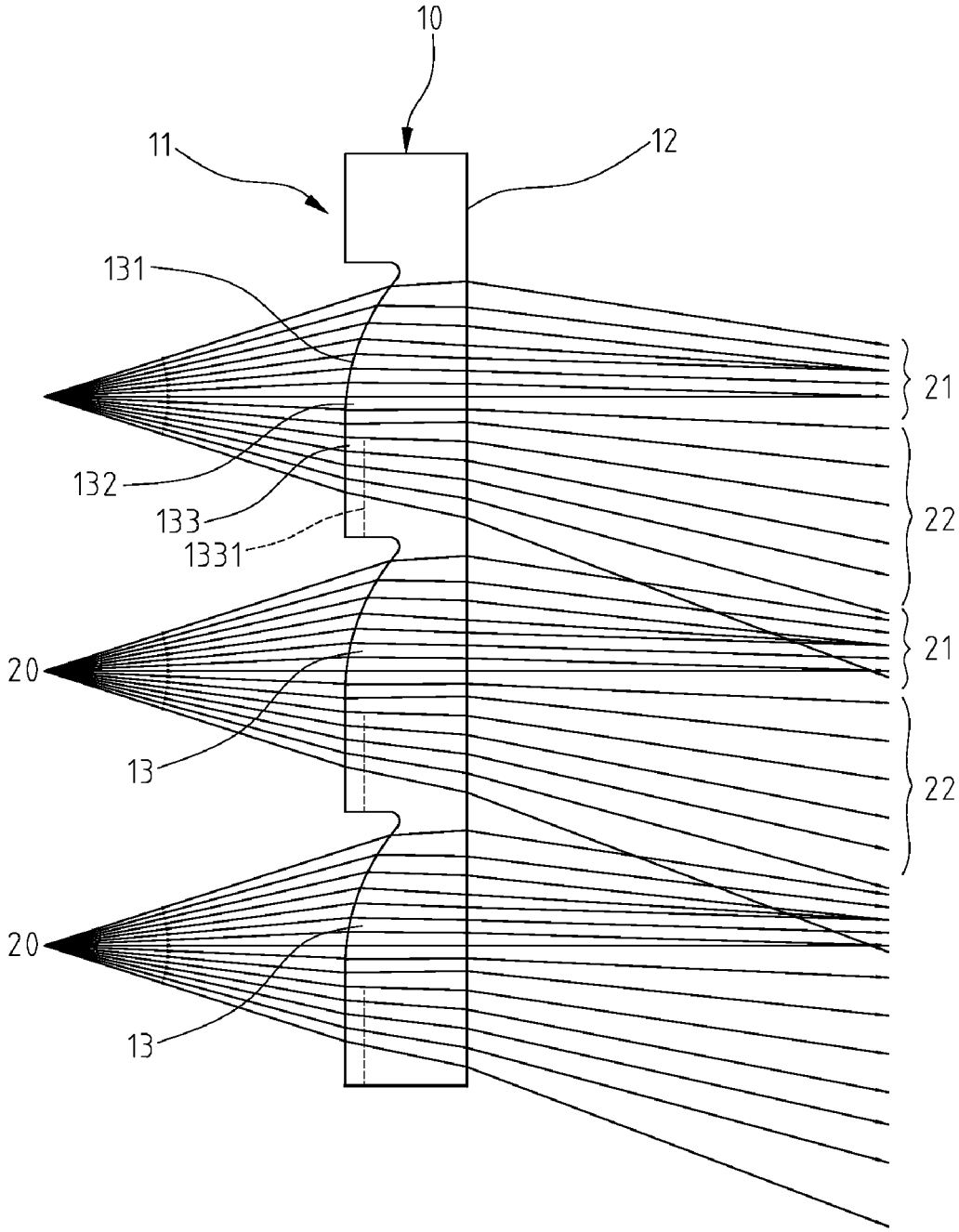
FIG. 2 (Prior Art)
FIG. 2 is a schematic view showing light transmission of the conventional front cover of traffic light.
Figure 7:
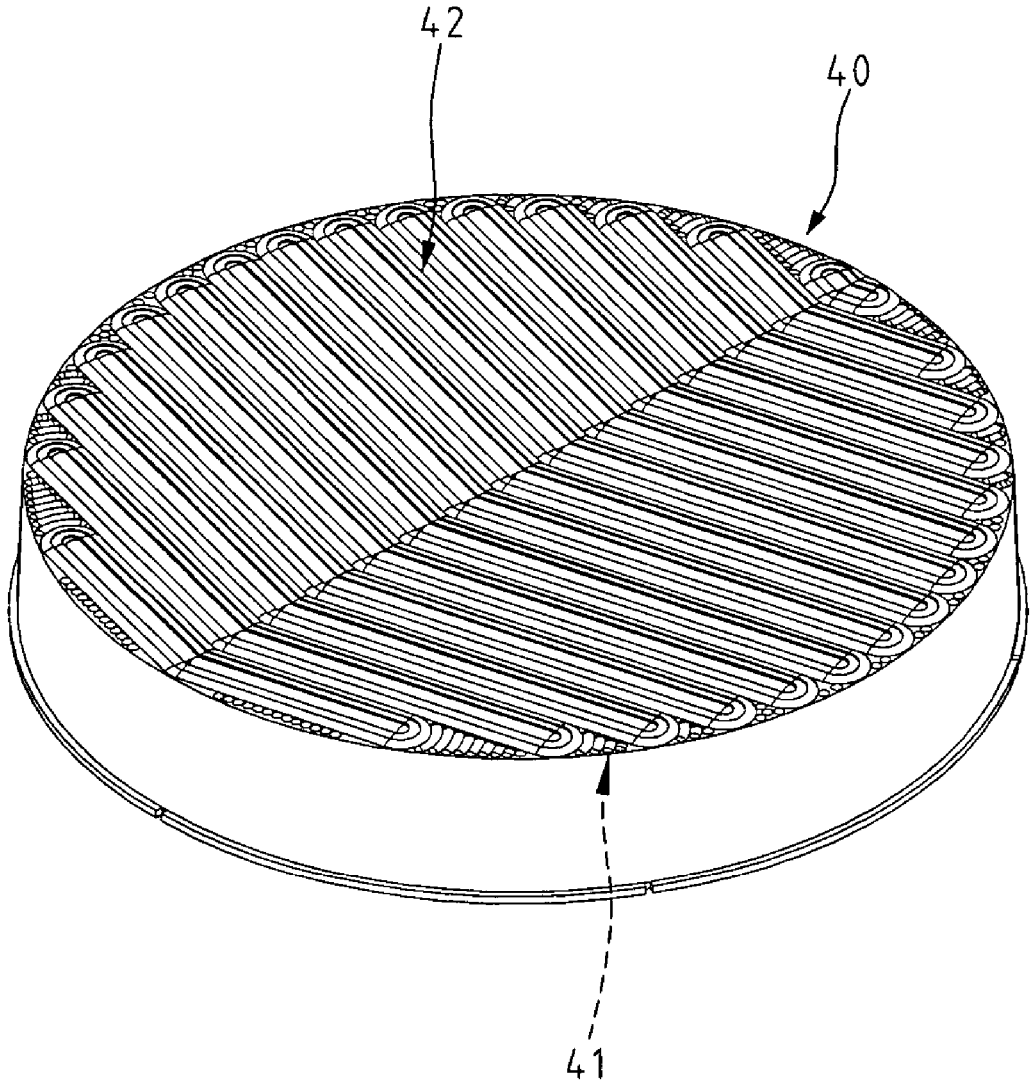
FIG. 7 is a perspective view of an inner cover of the traffic light in accordance with the present invention.
Figure 8:
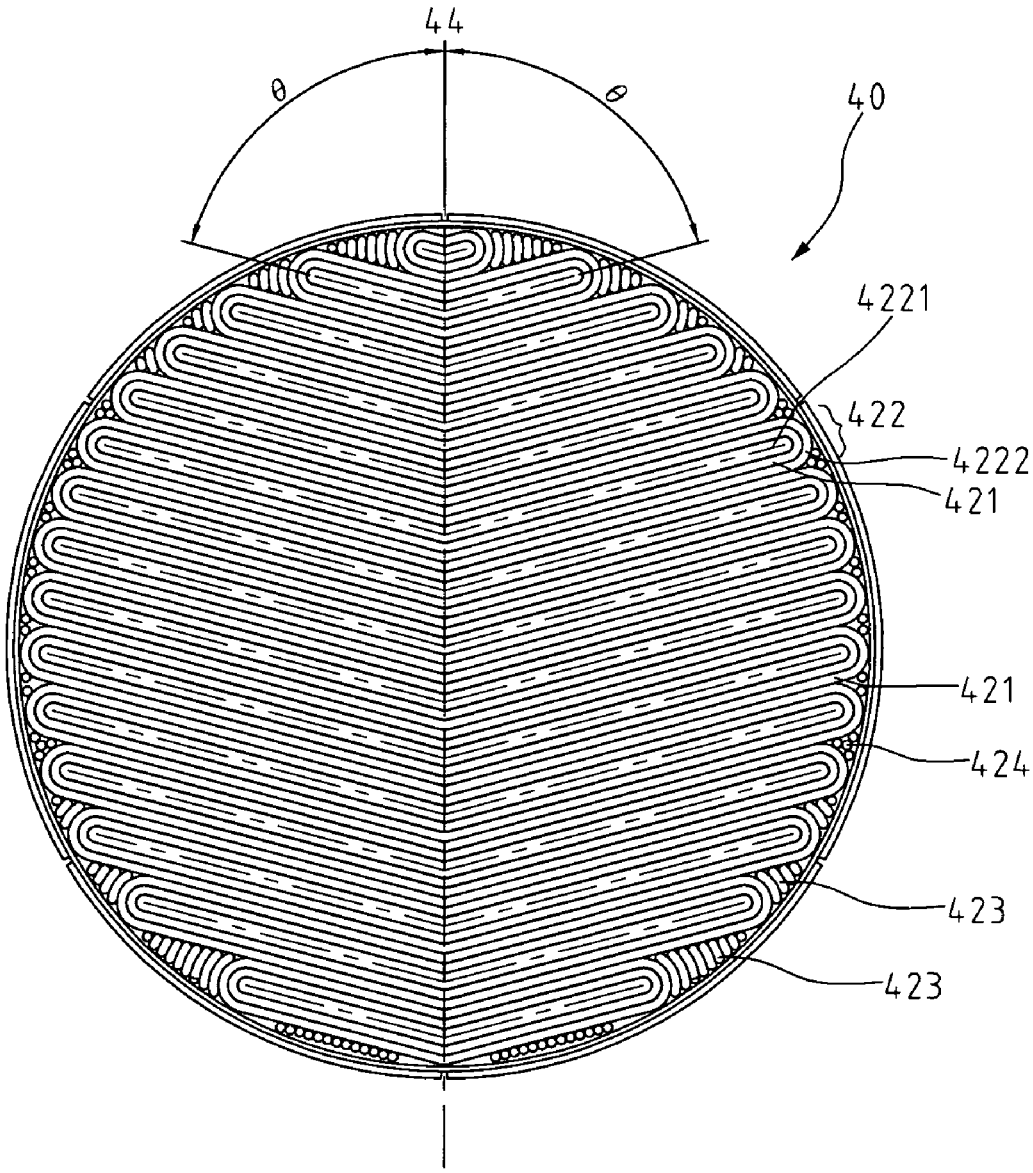
FIG. 8 is a front view of the inner cover of the traffic light of the present invention.

Also referring to FIGS. 7 and 8, the inner cover 40 is arranged between the light source 50 and the front cover 30. The light incidence surface 41 of the inner cover 40 comprises a smooth surface, which can be flat, convex or concave. The light emission surface 42 of the inner cover 40 forms a plurality of elongate ribs or raised strips having curved or convex cross-section with predetermined radius of curvature, serving as prisms 421 of curved cross section, of which a lengthwise direction is inclined with respect to a vertical center line 44 of the light emission surface 42 with an included angle (θ) of 65-80 degrees, whereby the prisms 421 on opposite sides of the center line 44 form a V-shaped arrangement, preferably symmetric about the center line 44, which arrangement enhances uniformity of distribution of light intensity on a projection area. Such uniformity can be maintained even if a vertical view angle of an observer changes to some extents. If the included angle between the prisms 421 and the center line 44 is not within the range of 65-80 degrees, non-uniform distribution of light intensity can be observed, similar to what happens in the conventional designs as illustrated in FIG. 2. In addition, dark and bright strips of such a non-uniform distribution may be shifted in the vertical direction due to change of vertical view angle. This not only causes poor visual effect, but also illustrates non-uniform light projection of the traffic light.

In the embodiment illustrated, every five consecutive prisms 421 are grouped together as a set. Remote ends of the prisms 421 of each group are connected with curved sections 4222 adjacent to outer circumference of the light emission surface 42. The central one of the five prisms 421 of each group is designated as a central prism 4221. The central prism 4221 is arranged to correspond to the location and inclined angle (θ) of a corresponding linear array of LEDs 51 on the circuit board 52, see FIG. 9. Such an arrangement allows each of the LEDs 51 to generate a number of images through refraction caused by the prisms 421 of the group.

Although in the embodiment illustrated five consecutive prisms 421 are grouped together as a prism set 422, the number of the prisms 421 contained in each set 422 can be different, provided the number is an odd number whereby a central prism can be identified. Also, the width of the prisms can be different or is in such a manner to allow each set 422 of the prisms 421 to exactly correspond to a linear array of the LEDs 51. Small fragments of unoccupied area on the light emission surface 42 of the inner cover 40 are preferably occupied by curved prisms 423 and circular projections serving as circular lenses 424, both functioning to refract a portion of the light emitted from the LEDs 51 to maintain integrity of the shape of the outer circumference of the traffic light.

Figure 10:
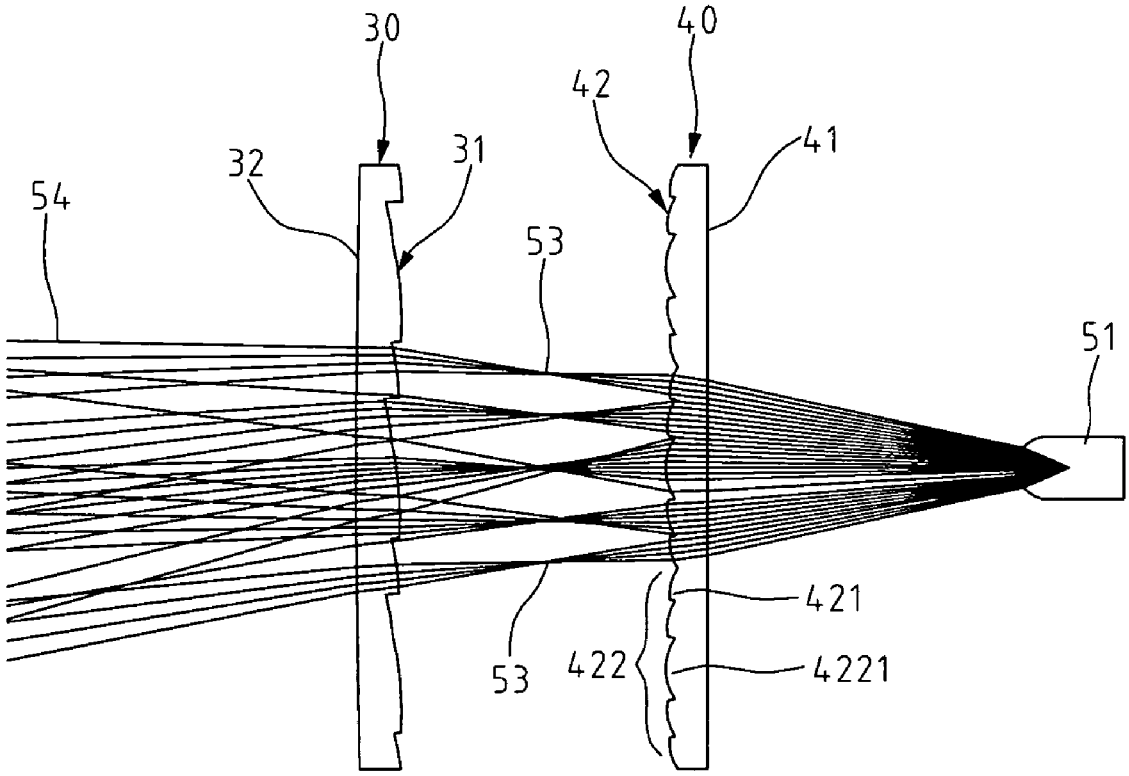
FIG. 10 schematically illustrates light transmission of the light projected from the traffic light in accordance with the present invention.

Referring now to FIG. 10, transmission of the light emitted from the LED 51 through the inner cover 40 and the front cover 30 is illustrated. The light, after emitted from the LED 50, is projected to the light incidence surface 41 of the inner cover 40, through which the light enters the inner cover 40. The light is then refracted by each prism 421 contained in the associated prism set 422, whereby each prism 421 forms an image of the LED 50. In the embodiment illustrated, the prism set 422 contains five consecutive prisms 421 and thus five images of the LED 50 are formed after the light transmits through the inner cover 40. The increased number of image makes the distribution of light intensity more uniform.

Lights of the five images then travel to and enter the front cover 30 through the light incidence surface 31 of the front cover 30 and refracted by the lens blocks 311 of the light incidence surface 31. Eventually, the light is projected through the light emission surface 32 of the front cover 30 as projected light 54 traveling in a downward inclined direction toward the eyes of drivers and pedestrians located below the traffic light.

Figure 11:
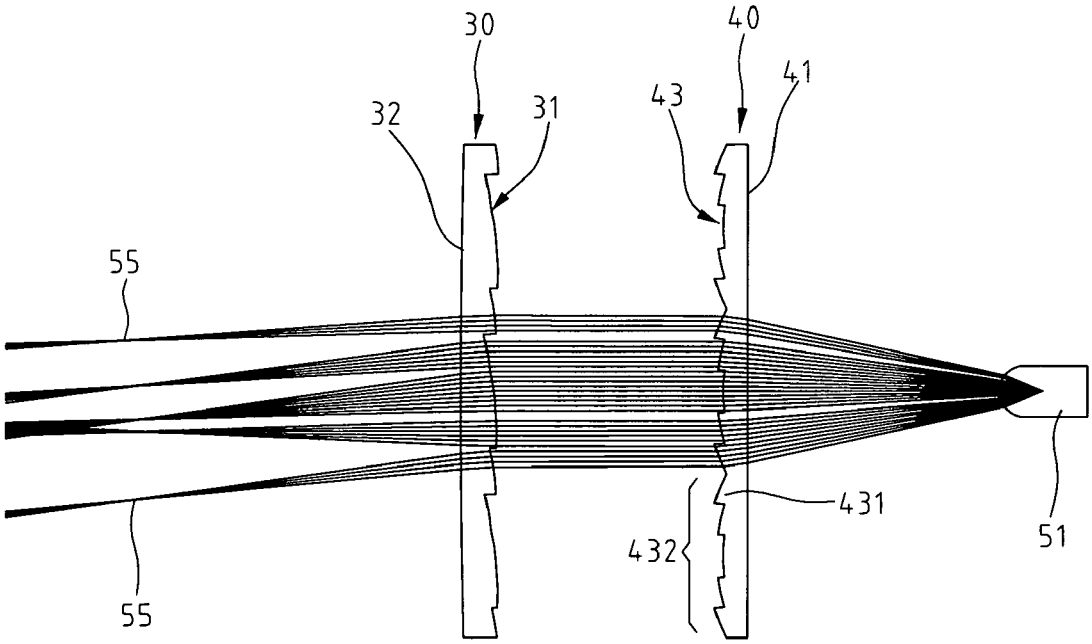
FIG. 11 schematically illustrates light transmission of the light projected from a traffic light constructed in accordance with another embodiment of the present invention.

In the embodiment illustrated above, the prisms 421 of the inner cover 42 have a curved or convex cross-section, which serves to form separate image for the associated LED 51. Thus, each prism group 422 that contains five such prisms 421 that have curved cross-section can form five separate images. As mentioned above, increasing the number of the images helps to uniform light distribution. However, it is apparent to those having ordinary skills to replace the curved or convex cross-section with a flat surface, either straight or inclined, as illustrated in another embodiment of the present invention particularly shown in FIG. 11, wherein each prism that is designated with reference numeral 431 has a straight or inclined, flat surface. And similar to the previous embodiment, five consecutive prisms 431 forms a prism group or prism set 432 corresponding to each linear array of the LEDs 51. Such flat surfaces of the prisms 431 do not form separate images for each LED 51 and only redirect the light from the LED 50 in a frontward direction, preferably substantially in a mutually parallel manner. However, the front cover 30, which is of the same structure as the previous embodiment, still function to form individual images 55 for the light projected from the light emission surface 43 of the inner cover 40. This also helps uniforming the distribution of light intensity.

Although the present invention has been described with reference to the preferred embodiment thereof, it is apparent to those skilled in the art that a variety of modifications and changes may be made by replacing elements with those of equivalent or similar nature, without departing from the scope of the present invention which is intended to be defined by the appended claims.

What is claimed is:

1. A traffic light comprising:

a light source comprising a circuit board on which a plurality of light-emitting diodes is mounted, the light-emitting diodes forming at least a linear array;

an inner cover positioned in front of the light source, comprising a first light incidence surface facing the light-emitting diodes to receive light from the array of the light-emitting diodes and an opposite, first light emission surface forming elongate prisms inclined with respect to a predetermined axis at a predetermined angle of 65-80 degrees to project the light frontward; and a front cover positioned in front of the inner cover, comprising a second light incidence surface facing the first light emission surface of the inner cover to receive the light from the inner cover, and an opposite, second light emission surface through which the light is further projected out of the traffic light, the second light incidence surface forming a honeycomb structure comprising a plurality of hexagonal lens blocks, each hexagonal lens blocks comprising an array of individual lens segments;

wherein each lens block has a first radius of curvature in horizontal direction and a second radius of curvature in vertical direction, the first radius of curvature being identical to the second radius of curvature.

2. A traffic light comprising:

a light source comprising a circuit board on which a plurality of light-emitting diodes is mounted, the light-emitting diodes forming at least a linear array;

an inner cover positioned in front of the light source, comprising a first light incidence surface facing the light-emitting diodes to receive light from the array of the light-emitting diodes and an opposite, first light emission surface forming elongate prisms inclined with respect to a predetermined axis at a predetermined angle of 65-80 degrees to project the light frontward; and a front cover positioned in front of the inner cover, comprising a second light incidence surface facing the first light emission surface of the inner cover to receive the light from the inner cover, and an opposite, second light emission surface through which the light is further projected out of the traffic light, the second light incidence surface forming a honeycomb structure comprising a plurality of hexagonal lens blocks, each hexagonal lens blocks comprising an array of individual lens segments;

wherein each lens segment has a first radius of curvature in horizontal direction and a second radius of curvature in vertical direction, the first radius of curvature being identical to the second radius of curvature.

3. A traffic light comprising:

a light source comprising a circuit board on which a plurality of light-emitting diodes is mounted, the light-emitting diodes forming at least a linear array;

an inner cover positioned in front of the light source, comprising a first light incidence surface facing the light-emitting diodes to receive light from the array of the light-emitting diodes and an opposite, first light emission surface forming elongate prisms inclined with respect to a predetermined axis at a predetermined angle of 65-80 degrees to project the light frontward; and a front cover positioned in front of the inner cover, comprising a second light incidence surface facing the first light emission surface of the inner cover to receive the light from the inner cover, and an opposite, second light emission surface through which the light is further projected out of the traffic light, the second light incidence surface forming a honeycomb structure comprising a plurality of hexagonal lens blocks, each hexagonal lens blocks comprising an array of individual lens segments;

wherein each lens segment has a first radius of curvature in horizontal direction and a second radius of curvature in vertical direction, the first radius of curvature being different from the second radius of curvature.

4. A traffic light comprising:

a light source comprising a circuit board on which a plurality of light-emitting diodes is mounted, the light-emitting diodes forming at least a linear array;

an inner cover positioned in front of the light source, comprising a first light incidence surface facing the light-emitting diodes to receive light from the array of the light-emitting diodes and an opposite, first light emission surface forming elongate prisms inclined with respect to a predetermined axis at a predetermined angle of 65-80 degrees to project the light frontward; and a front cover positioned in front of the inner cover, comprising a second light incidence surface facing the first light emission surface of the inner cover to receive the light from the inner cover, and an opposite, second light emission surface through which the light is further projected out of the traffic light, the second light incidence surface forming a honeycomb structure comprising a plurality of hexagonal lens blocks, each hexagonal lens blocks comprising an array of individual lens segments;

wherein the prisms are grouped into a plurality of prism sets each containing a predetermined number of consecutive prisms corresponding in position to each linear array of light-emitting diodes.

5. The traffic light as claimed in claim 4, further comprising at least a curved section connecting remote ends of the prisms contained in each prism set.

6. The traffic light as claimed in claim 4, wherein the predetermined number is five of which a central prism is located in correspondence to the linear array of light-emitting diodes.

7. The traffic light as claimed in claim 4, further comprising at least a curved section connecting remote ends of the prisms contained in each prism set, and wherein circular convex lens and curved prisms are formed on a portion of the first light emission surface that is not occupied by the prism sets.

8. The traffic light as claimed in claim 4, wherein each lens block has a first radius of curvature in horizontal direction and a second radius of curvature in vertical direction, the first radius of curvature being different from the second radius of curvature.

9. The traffic light as claimed in claim 4, wherein the prisms are arranged on opposite sides of the axis to form a V-shaped configuration.

* * * * *